United States Patent [19]

Poncin

[11] 4,182,058

[45] Jan. 8, 1980

[54] TEETH OF BUCKETS FOR MECHANICAL AND HYDRAULIC SHOVELS

[75] Inventor: André Poncin, 27, Rte. de Warnecourt, 08 Prix les Mezieres, France

[73] Assignee: André Poncin, France

[21] Appl. No.: 866,901

[22] Filed: Jan. 4, 1978

[30] Foreign Application Priority Data

Jan. 14, 1977 [FR] France ..... 77 01060

[51] Int. Cl.[2] ..... E02F 9/28

[52] U.S. Cl. ..... 37/142 A

[58] Field of Search ..... 37/142 A; 299/92

[56] References Cited

U.S. PATENT DOCUMENTS

| | | | |
|---|---|---|---|
| 2,990,634 | 7/1961 | Eyolfson | 37/142 A |
| 3,025,619 | 3/1962 | Towne et al. | 37/142 A |
| 3,388,488 | 6/1968 | Duplessis | 37/142 A |
| 3,406,471 | 10/1968 | Duplessis | 37/142 A |

*Primary Examiner*—Clifford D. Crowder

*Attorney, Agent, or Firm*—Watson, Cole, Grindle & Watson

[57] ABSTRACT

A device is provided for attaching a hollow tooth to the nose of a fixed support, for example a support forming part of the bucket of a mechanical shovel. The nose has a curved bore and a resilient steel cotter passes through the bore and through orifices in the walls of the tooth. One end of the cotter cooperates with an inclined plane of one orifice and the other end having a shoulder cooperates with a projecting portion of a wall of the other orifice.

3 Claims, 1 Drawing Figure

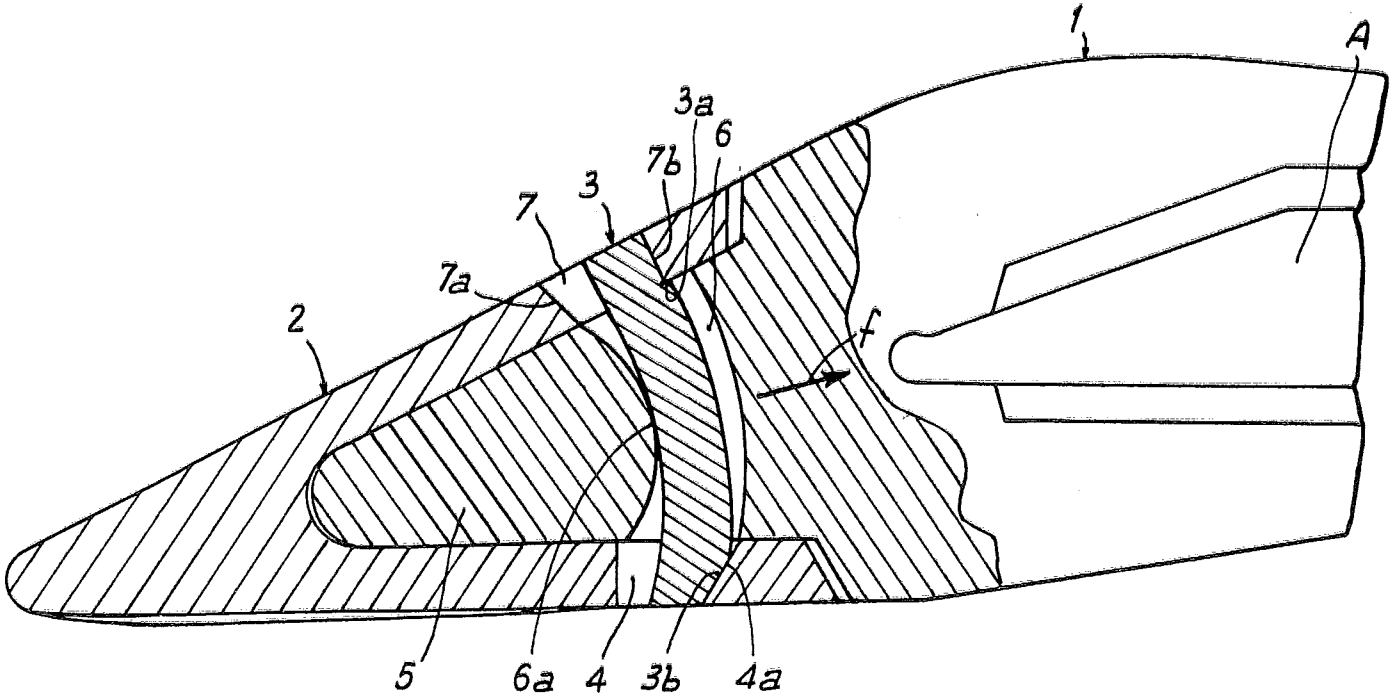
A
1
2
3
3a
3b
4
4a
5
6
6a
7
7a
7b
x

TEETH OF BUCKETS FOR MECHANICAL AND HYDRAULIC SHOVELS

FIELD OF THE INVENTION

The present invention relates to improvements in or relating to the teeth of buckets for mechanical and hydraulic shovels, excavators, loaders or other similar machines used in civil engineering.

BACKGROUND OF THE INVENTION

The buckets of mechanical shovels are provided at their base with a strip upon which teeth are fixed. As these teeth can wear out fairly quickly when moving earth in hard ground, they often have to be replaced, and the worn out teeth are thrown away even though they still constitute a large mass of special steel which is thus lost.

In order to avoid these losses, it has been proposed that each tooth be made in two parts, namely a first part forming a support fixed to the blade and ending in a nose, and a second, wearing part, in the form of a hollow tooth which is replaceably mounted on the nose. In use, the hollow tooth is replaced when it wears out, but the support part, which contains the larger weight of metal, is retained.

The hollow tooth is fixed to the supporting nose by a system of cotters. In particular, a known method involves making a substantially vertical hole in the nose and the tooth and inserting in the hole a steel cotter connected to a rubber block which keeps the cotter in place. However, this system is not entirely satisfactory and teeth frequently become detached from their support.

OBJECT OF THE INVENTION

The object of the present invention is to provide a resilient system of cotters which may easily be installed and removed and which, through its resilience keeps the teeth in place despite impacts and wear.

SUMMARY OF THE INVENTION

The invention provides a construction comprising a hollow tooth detachably mounted on a fixed support provided with a nose, by means of a resilient steel cotter, wherein the nose is provided with a curved bore extending transversely through the nose, and opposed walls of the tooth are each provided with a respective orifice, each orifice communicating with a respective end of the said curved bore, one orifice comprising an inclined wall and the corresponding wall of the other orifice projecting partially across the curved bore, the cotter having a surface at one end which cooperates with the inclined wall, a shoulder at its other end which cooperates with the projecting portion of the corresponding wall of the other orifice, and a middle portion which rests against a convex portion of the curved bore.

BRIEF DESCRIPTION OF THE INVENTION

The accompanying drawing is a lateral view of a fixing system according to the present invention, given by way of example to facilitate understanding of the invention.

DETAILED DESCRIPTION OF PREFERRED EMBODIMENT

The drawing shows a tooth which comprises a support part.

The having a recess A into which the blade of a bucket (not shown) is inserted, the support ending at its forward end in a nose 5. A tooth 2 which constitutes the wearing part which may be replaced without having to replace the support 1, is fitted on the nose 5.

Extending completely through the nose 5 is a curved bore-hole 6, and the tooth 2 has two orifices 4 and 7 formed therein which are positioned opposite the two ends of the bore-hole 6.

The lower orifice 4 has an inclined plane 4*a*, the top of which extends to the rear wall of the bore-hole 6.

The front wall 7*a* of the upper orifice 7 is aligned with the corresponding wall of the bore-hole 6, but the rear wall 7*b* projects into the bore-hole.

The nose 5 and the tooth 2 are joined together by means of a curved resilient cotter 3 composed of steel the curvature of the cotter being less than the curvature of the bore-hole 6. The cotter 3 has at its upper end a shoulder 3*a* and at its lower end an inclined plane 3*b*. Once the tooth 2 has been positioned on the nose 5, the cotter 3 is introduced into the orifice 7 and the bore-hole 6.

Since the curvature of the cotter is less than that of the bore 6, the cotter 3 has to be forced in so that its inclined plane 3*b* slides against the inclined plane 4*a*. The cotter 3 is forced in until the shoulder 3*a* slides beneath the wall 7*b* of the orifice 7 and thus holds the cotter 3 in position.

The middle part of the cotter 3 rests against the curved middle part 6*a* of the bore hole 6 of the nose 5, and the two ends of the cotter 3 rest against the rear walls 7*b* and 4*a* of the orifices 4 and 7 formed in the tooth 2. The tooth is thus permanently pulled by the resilience of the cotter 3 in the direction shown by the arrow f and the tooth 2 is wedged on to the nose 5 in a secure fashion.

I claim:

1. A replaceable metallic tooth cap mounted on a nose of a support, the nose having a cross-bore, orifices in the cap having central axes and communicating with opposite ends of said bore, and a cotter extending through said bore and said orifices for mounting the cap on said nose, the improvement wherein said bore is defined by a wall presenting a metallic surface which has a first radius of curvature, said cotter being of spring steel and having a radius of curvature greater than said first radius of curvature so as to be spring bent in place while engaging said metallic surface and walls of said orifices, one of said orifice walls being inclined relative to the central axis of said orifice at said one wall, the other of said orifice walls having a portion projecting partially into said bore, said cotter having a surface at one end thereof cooperating with said inclined wall, and said cotter having a shoulder at an opposite end thereof cooperating with said projecting portion, whereby said cap is securely mounted on said nose.

2. The cap according to claim 1, wherein said nose has a tip end, and said metallic surface is convex and faces away from said tip end.

3. The cap according to claim 1, wherein said cotter has a slight inherent curvature in a relaxed condition thereof.

* * * * *